US008783184B1

(12) United States Patent
Calvert

(10) Patent No.: US 8,783,184 B1
(45) Date of Patent: Jul. 22, 2014

(54) BROADHEAD PUSH-OUT BULLET

(71) Applicant: BPOB Associates, Trustee for Broadhead POB CRT Trust, Manassas, VA (US)

(72) Inventor: S. Mill Calvert, Manassas, VA (US)

(73) Assignee: BPOB Associates, Trustee for Broadhead POB CRT Trust, Manassas, VA (US)

( * ) Notice: Subject to any disclaimer, the term of this patent is extended or adjusted under 35 U.S.C. 154(b) by 0 days.

(21) Appl. No.: 14/057,417

(22) Filed: Oct. 18, 2013

(51) Int. Cl.
*F42B 10/00* (2006.01)

(52) U.S. Cl.
USPC ..... 102/439; 102/517; 102/518; 102/501

(58) Field of Classification Search
USPC ..... 102/439, 517, 518, 501
See application file for complete search history.

(56) References Cited

U.S. PATENT DOCUMENTS

| | | | | |
|---|---|---|---|---|
| 4,798,143 | A | 1/1989 | Graham | |
| 5,020,438 | A | 6/1991 | Brown | |
| 5,440,994 | A | 8/1995 | Alexander | |
| 6,439,127 | B1 * | 8/2002 | Cherry | 102/519 |
| 6,845,718 | B2 * | 1/2005 | Fortner et al. | 102/518 |
| 8,418,624 | B2 * | 4/2013 | McGarraugh et al. | 102/517 |
| 2006/0213105 | A1 * | 9/2006 | Cugliari | 42/1.01 |
| 2012/0266772 | A1 * | 10/2012 | Eckstein | 102/439 |
| 2013/0263754 | A1 * | 10/2013 | Neme | 102/439 |

OTHER PUBLICATIONS

Sage Control Ordinance Inc., Model BP45, 40MM Baricade Penetrating Projectile, specifications, published online at http: // www.sageinternationalltd.com/SCOI/specs/SCOI_SpecSheet_BP45.pdf, downloaded Oct. 10, 2013.

* cited by examiner

*Primary Examiner* — J. Woodrow Eldred
(74) *Attorney, Agent, or Firm* — Louis Ventre, Jr.

(57) ABSTRACT

A cartridge for a firearm has a bullet that defines an internal chamber. The chamber has a broader top portion than a lower portion. The bullet further defines a channel passage leading out of the top end of the bullet. The bullet contains an arrowhead slidable engaged within the channel passage. A shaft is connected to the arrowhead and passes down from the arrowhead into the lower portion of the chamber. A thrust plate is connected to the shaft end in the chamber. The thrust plate is spring metal and when the cartridge is fired, the thrust plate rises pushing the arrowhead so that it extends from the leading end of the bullet. When the thrust plate rises to the second portion of the chamber, it springs open to prevent subsequent downward motion of the thrust plate and consequently prevents subsequent retraction of the arrowhead during flight and after impact.

4 Claims, 3 Drawing Sheets

BROADHEAD PUSH-OUT BULLET

TECHNICAL FIELD

In the field of ammunition and explosives, a bullet with an extensible arrowhead that fits within a cartridge for a firearm.

BACKGROUND ART

Military and police special forces can encounter terrorists, enemy combatants or criminals using bullet proof vests or hardened enclosures such as bullet proof cars and trucks. Conventional bullets, made primarily from lead, often become deformed and less effective after striking hard targets, especially when fired at handgun velocities. These are not easily overcome and penetrated with normal ammunition, which spreads upon impact. When it spreads, the larger impact area prevents penetration.

Ballistic vests are designed to resist penetration of blunt projectiles, such as are typically used for hand guns. Special purpose handgun ammunition, such as a high-powered, hardened metal bullet is used to overcome ballistic vest and other hard targets. These are essentially bullets manufactured with non-deformable materials that resist expansion upon impact. This feature inherently diminishes the effectiveness of the bullet. Their high power also makes these bullets less favored for normal use both because of recoil and the potential to breach buildings and transit to other unintended targets.

Arrows, knives and ice picks have sharp points and do not have the same tendency to flatten. Thus, they will pierce ballistic vests that do not have an additional trauma plate. Arrows with pointed tips are known to pierce bullet proof vests and arrows with TEFLON tipped razor heads do so more reliably.

An arrowhead is a projectile point or tip of an arrow. It is usually pointed or sharpened to make it more penetrating in a target. For penetrating hard targets, the arrowhead has a clear advantage. An arrowhead's application and extensibility from a bullet is new.

For a great deal of man's history on earth, the sharp cutting edge of a broadhead meant the difference between life and death. It was used to protect family, to put food on the table, and in all of the countless wars and conquests to kill the enemy. As the broadhead and development of guns became prevalent, the razor-sharp cutting edge of the broadhead was replaced with the energy and damage that a bullet can do. The broadhead was relegated to recreational purposed events such as deer hunting and has had little military use since.

With the invention of the broadhead push-out bullet, the broadhead has come full circle to once again be a valuable military and policing tool that will work in conjunction with the bullet, which had replaced it so many years ago. Now, the sharp edge of a broadhead can first cut open an area before the bullet enters to do its damage. It offers the penetrating effect of an arrow and the damage from an expanding bullet in a cartridge of ordinary power.

SUMMARY OF INVENTION

A cartridge for a firearm has a bullet that defines an internal chamber. The chamber has a broader top portion than the lower portion. The bullet further defines a channel passage leading out of the top end of the bullet from the chamber. The bullet contains an arrowhead slidable engaged within the channel passage. A shaft is connected to the arrowhead and passes down from the arrowhead into the lower portion of the chamber. A thrust plate is connected to the shaft end in the chamber. The thrust plate is spring metal and when the cartridge is fired, the thrust plate rises pushing the arrowhead so that it extends from the leading end of the bullet. When the thrust plate rises to the second portion of the chamber, it stops at the top of the second portion preventing further outward movement of the arrowhead. Upon entering the second portion, the thrust plate springs open to prevent subsequent downward motion of the thrust plate and consequently prevents subsequent retraction of the arrowhead during flight and after impact.

Technical Problem

Bullets for penetrating ballistic vests are high power, hardened metal projectiles that may pierce the target and cause insufficient damage because they are non-deformable and do not expand upon impact. They can travel through a target and cause collateral damage by piercing a building or other unintended target.

Solution to Problem

The solution is a bullet that can pierce a bullet proof vest with a standard propellant charge and also expand to cause maximal damage within the target. The solution is a broadhead push-out bullet according to the disclosure herein. This solution provides a bullet that will substitute for the standard ammunition for any gun and fire with similar performance as that standard ammunition, yet have the ballistic vest penetrating performance of much more powerful bullets.

Advantageous Effects of Invention

There can be many different uses to be able to first cut or pierce a hole before a bullet enters. For instance, if a terrorist is wearing a bullet-proof vest, the broadhead push-out bullet will go right through the vest because the sharp edges of the broadhead will cut apart the fibers in the vest so the bullet can pass through.

Because the broadhead is not pushed out until the bullet is loaded into the barrel and then fired, it will fit and work in any gun or gun mechanism like any other cartridge. When the broadhead push-out bullet is fired and travels through the barrel, it does not in any way interfere with the riffling or bullet spin because it is narrower than the diameter inside of the barrel.

When the energy of the bullet enters the target, the resistance pushing against the extended broadhead causes the bullet to mushroom and expand, doing more target damage.

The broadhead can have other features included such as an armor-piercing spike that sticks out. The modern-day soldier will now be able to use a cartridge have the benefits of both a broadhead and a bullet.

In today's War on Terror and regional conflicts, the broadhead push-out bullet is a new, useful tool that will keep America's soldiers safe and help to keep America strong. It will give police and special weapons and tactical (SWAT) team members added tools to overcome criminals employing ballistic protection.

BRIEF DESCRIPTION OF DRAWINGS

The drawings illustrate preferred embodiments of the broadhead push-out bullet according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the broadhead push-out bullet. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
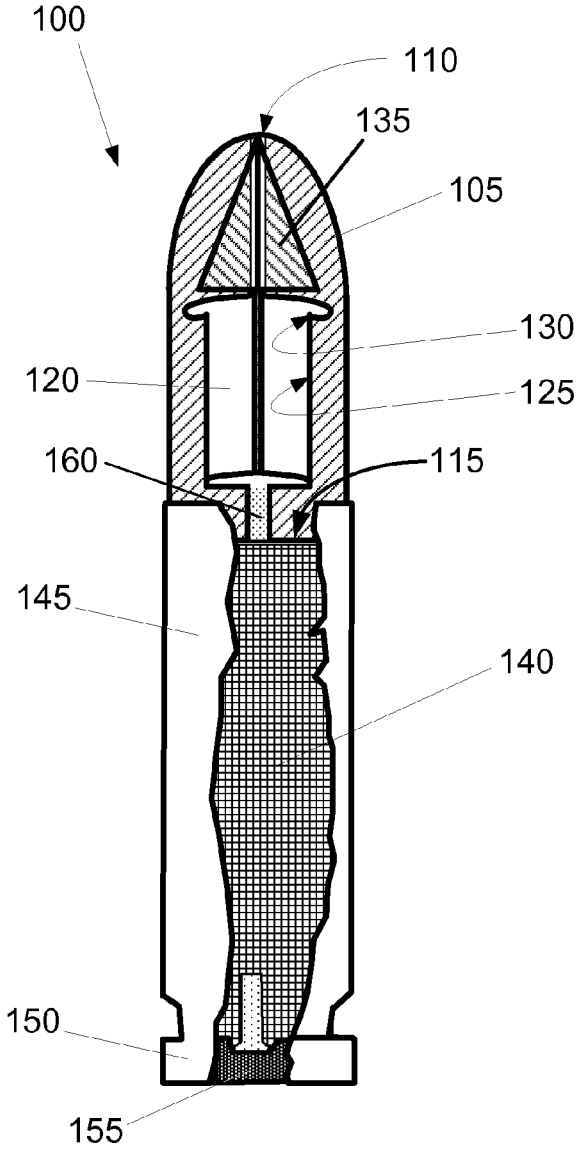
FIG. 1 is a sectional elevation view of a ready-to-fire cartridge with the broadhead push-out bullet.

FIG. 1 is a sectional elevation view of a cartridge (100) that is ready-to-fire. It includes a bullet (105), as described herein, namely the broadhead push-out bullet. The cartridge (100) is for a firearm in that it is intended to be fired from a weapon. As with typical cartridges for guns, there is included in the cartridge a propellant (140), bullet case (145) that holds the bullet (105), a rim (150) at the firing end of the cartridge, and a primer (155) that once struck by a firing pin of the weapon ignites the propellant (140) and sends the bullet (105) on its way. A sealant (160), such as wax, paper or a wadding material, may be used to close the bottom end of the bullet to prevent propellant (140) from prematurely entering the chamber (120). Alternatively, the thrust plate (315) may be structured to close off the propellant-end (115).

Figure 2:
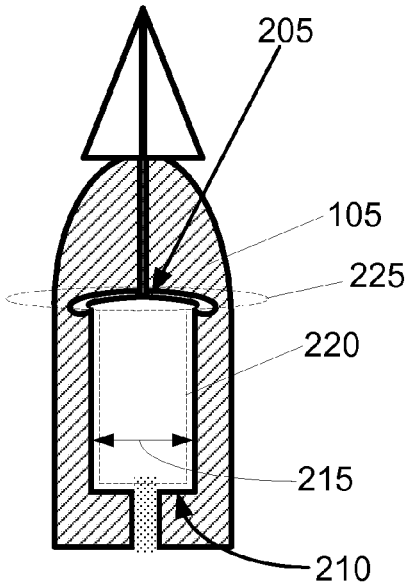
FIG. 2 is a sectional elevation view of the broadhead push-out bullet after it is fired from a cartridge.

The bullet (105) has an external end (110) and a propellant-end (115) within the cartridge (100). The bullet (105) defines a chamber (120) within its confines. The chamber (120) includes a chamber top-end (205), as shown in FIG. 2, a chamber bottom-end (210), and a chamber width (215), which are designated so that they can be referenced to better describe the structure of the bullet (105). The chamber top-end (205) is situated nearest the external end (110) of the bullet (105) and the chamber bottom-end (210) situated nearest the propellant-end (115). The terms vertical or horizontal are used herein with reference to the orientation shown in FIG. 1.

The chamber (120) has a first portion (220), the first portion (220) comprising a wall (125) extending vertically between the chamber bottom-end (210) and a point (130) below the chamber top-end (205). The first portion (220) is preferably a cylindrical lower part of the chamber (120) with a fixed diameter.

Figure 3:
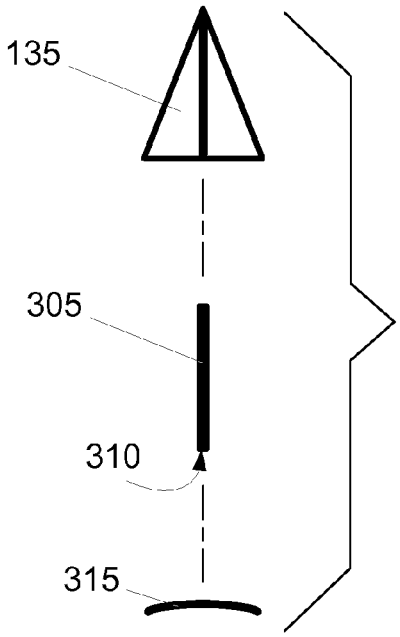
FIG. 3 is an exploded view of the arrowhead, shaft and thrust plate.
Figure 5:
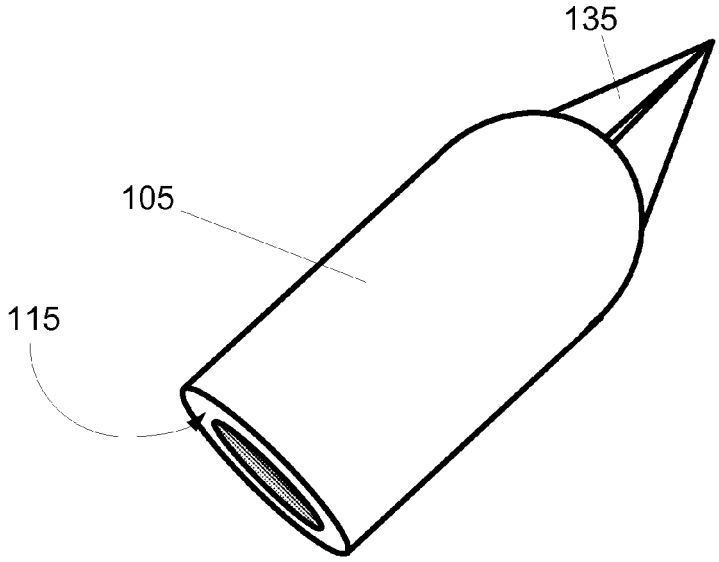
FIG. 5 is a perspective view of the broadhead push-out bullet after it is fired from a cartridge.

The chamber (120) has a second portion (225), the second portion (225) enlarging the chamber width (215) and extending from the chamber top-end (205) to the point (130). When the first portion (220) of the chamber (120) is a cylinder, the second portion (225) sits at the top of the first portion (220) like a hat. The second portion (225) has a larger diameter than the first portion (220). This expanded width of the second portion (225) enables room for the thrust plate (315) to spring into it and once it has sprung into the second portion (225), the thrust plate (315), shown in FIG. 3, cannot thereafter move downward into the first portion (220). This structural arrangement prevents downward movement of the thrust plate (315) and consequently the arrowhead (135). Any such downward movement of the arrowhead (135) would retract the arrowhead (135) from its extended position jutting out from the external end (110) or top of the bullet (105) and preclude its effectiveness in penetrating the target. A perspective of a bullet (105) with the arrowhead (135%) extended is illustrated in FIG. 5.

Figure 4:
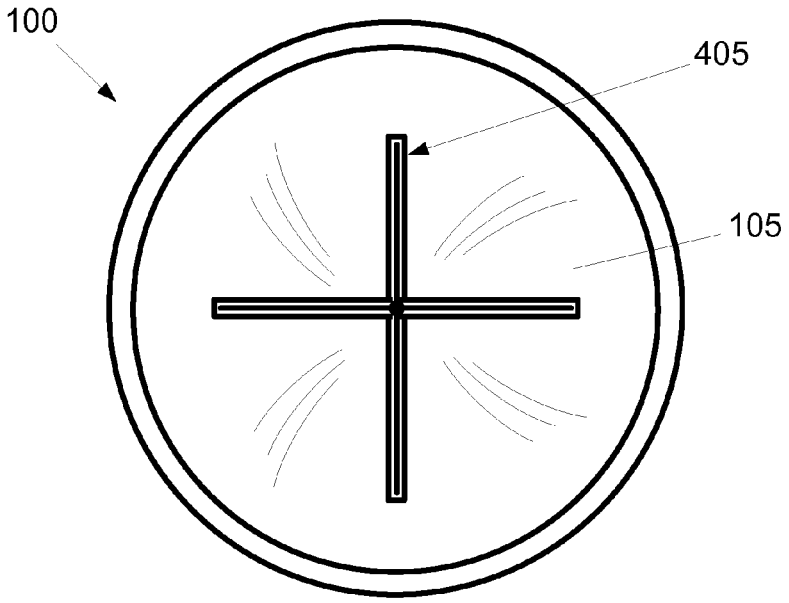
FIG. 4 is a top view of a cartridge with the broadhead push-out bullet.

The bullet (105) further defines a channel passage (405), illustrated in FIG. 4, which leads out of the bullet (105) through the external end. The channel passage includes one or more passages to permit slidable movement of the shaft (305) and the arrowhead (135) within the bullet (105). In manufacture, the channel passage (405), or passages as may be present for the arrowhead design, may be closed off by pressing against the arrowhead (135) to prevent contamination, for example by dirt. Such passages may alternatively be filled with wax or other sealant that similarly presents only minimal resistance to the slidable exit of the arrowhead (135) from within the bullet (105).

The cartridge (100) includes an arrowhead (135) slidable engaged within the channel passage (405). FIG. 4 is a top view of a cartridge (100) with a four-blade broadhead showing channel passages having a cross shape to permit the broadhead to extend out of the end of the bullet (105) when the cartridge (100) is fired.

Figure 7:
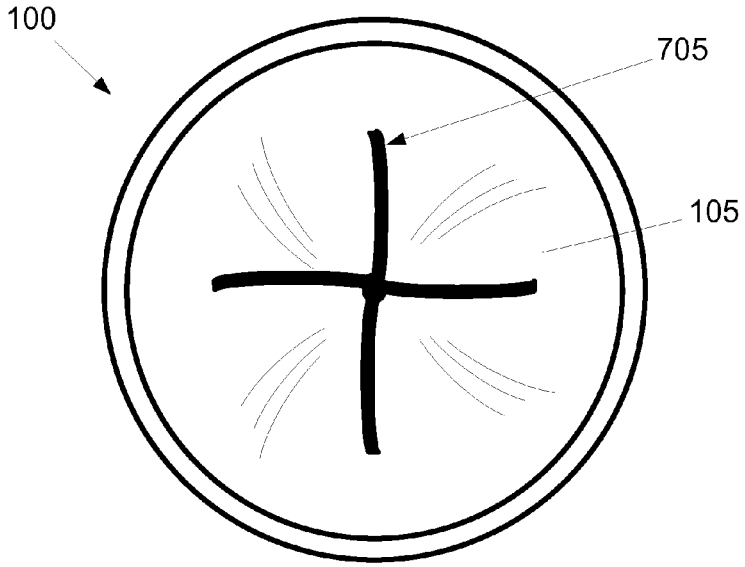
FIG. 7 is a top view of a cartridge showing a curved channel-passage suitable for curved broadhead blades.

The arrowhead (135) is a functional part of the broadhead push-out bullet in that it functions to deliver a pointed and preferably wide cutting edge to easily penetrate a bullet proof vest. The arrowhead (135) preferably comprises a four-blade broadhead. A broadhead is typically made from steel with hardened edges and usually has two to four sharp blades. There are two main types of broadheads: The fixed-blade and the mechanical types. While the fixed-blade broadhead keeps its blades rigid and unmovable on the broadhead at all times, the mechanical broadhead deploys its blades upon contact with the target, its blades swinging out to wound the target. Two or more broadhead blades may be made with a curl or warp, much like a fan blade, to promote bullet rotation. When the broadhead has four curved blades, then a curled, a curved channel-passage (705), as indicated in FIG. 7, may be employed to conform to the curl in the arrowhead blades. Thus, for a plurality of curved blades on the broadhead, the channel passage may be conformed to curve in a shape complementary to the plurality of curved blades.

Figure 6:
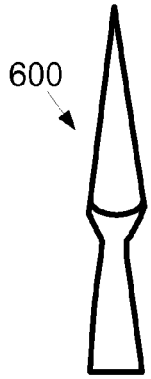
FIG. 6 is an elevation view of a bodkin point.

In other embodiments, the arrowhead (135) may comprise any sharpened or pointed tip commonly used for arrows. Examples include a bodkin point (600), shown in FIG. 6, and judo points. Judo points have spring wires extending sideways from the tip.

The cartridge (100) includes a shaft (305) connected to the arrowhead (135) and passing down from the arrowhead (135) to a shaft end-point (310) within the chamber (120). The shaft (305) provides the mechanical connection to move the arrowhead (135) when the cartridge (100) is fired.

The cartridge (100) includes the thrust plate (315) connected to the shaft end-point (310), the thrust plate (315) is comprised of a spring metal, preferably spring steel, and is configured to spring open when it rises to the second portion (225) and thereby inhibit downward motion of the thrust plate (315). When the propellant (140) in the cartridge explodes, it simultaneously fires the bullet (105) and drives the thrust plate (315) towards the external end (110) of the bullet (105) setting the arrowhead (135) into a deployed position extending from the external end (110) of the bullet (105). The hole connecting the propellant-end (115) of the bullet to the chamber (120), which is shown in FIG. 1 filled with a sealant (160), may be sized according to the propellant charge in the bullet and the malleability of the bullet. A soft lead bullet, for example, will need a smaller diameter hole than a jacketed coated lead bullet or a steel bullet. The hole size is determined so that the arrowhead (135) slides in the channel passage (405) and the thrust plate (315) does not push through the chamber top-end (205) when the cartridge (100) is fired.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A cartridge for a firearm, the cartridge comprising:

a bullet, the bullet comprising:

an external-end; and a propellant-end within the cartridge, the bullet defining a chamber, the chamber comprising:

a chamber top-end, a chamber bottom-end, and a chamber width, the chamber top-end situated nearest the external end of the bullet and the chamber bottom-end situated nearest the propellant-end;

a first portion, the first portion comprising a wall extending vertically between the chamber bottom-end and a point below the chamber top-end; and a second portion, the second portion enlarging the chamber width and extending from the chamber top-end to the point;

the bullet further defining a channel passage leading out through the external end;

an arrowhead slidable engaged within the channel passage;

a shaft connected to the arrowhead and passing down from the arrowhead to a shaft end-point within the chamber; and a thrust plate connected to the shaft end-point, the thrust plate comprised of a spring metal and configured to spring open when it rises to the second portion and thereby inhibit downward motion of the thrust plate.

2. The cartridge of claim 1, wherein the arrowhead comprises a broadhead.

3. The cartridge of claim 1, wherein the arrowhead comprises a bodkin point.

4. The cartridge of claim 1, wherein the arrowhead comprises a broadhead with a plurality of curved blades and the channel passage is conformed to curve in a shape complementary to the plurality of curved blades.

* * * * *